US005456541A

United States Patent [19]

Ching-Shui

[11] Patent Number: 5,456,541

[45] Date of Patent: Oct. 10, 1995

[54] KEY UNIT OF A KEYBOARD

[76] Inventor: Liao Ching-Shui, 2F, No.33-1, Lane 23, Ta Hu Shan Chun St., Taipei, Taiwan

[21] Appl. No.: 216,636

[22] Filed: Mar. 23, 1994

[51] Int. Cl.[6] ..... B41J 5/12

[52] U.S. Cl. ..... 400/490; 400/491; 400/491.2; 400/495; 200/5 A; 200/345

[58] Field of Search ..... 400/480, 481, 400/490, 491, 491.2, 491.3, 495; 200/5 A, 341, 345, 517

[56] References Cited

U.S. PATENT DOCUMENTS

| | | | |
|---|---|---|---|
| 4,859,820 | 8/1989 | Gotfryd et al. | 200/408 |
| 4,939,324 | 7/1990 | English et al. | 200/345 |
| 5,120,923 | 6/1992 | Kato et al. | 200/520 |
| 5,203,448 | 4/1993 | Osada et al. | 200/517 |
| 5,215,187 | 6/1993 | Ping-Chieng et al. | 200/517 |

FOREIGN PATENT DOCUMENTS

| | | | |
|---|---|---|---|
| 0272631 | 10/1989 | Germany | 400/491.2 |

*Primary Examiner*—Edgar S. Burr
*Assistant Examiner*—Lynn D. Hendrickson
*Attorney, Agent, or Firm*—W. Wayne Liauh

[57] ABSTRACT

An improved key unit of a keyboard comprising a key top, a keyboard plate and a conductive film; the conductive film being mounted beneath the keyboard plate; the keyboard plate has a mounting base comprising a hollow cylinder mounted thereon and the key top being mounted on the mounting base through the hollow cylinder. The key unit further comprises: (1) a lower portion of the key top having a stem extending therefrom; the stem having a blind hole therein and two symmetrical sides, the stem also having two salient blocks mounted on the two symmetrical sides; the mounting base having a mounting socket comprising two symmetrical guide grooves therein; beneath the two guide grooves, the mounting socket further comprising two stop-and-guide grooves being furnished and aligned to the guide grooves, but being slightly deeper than the two guide grooves, respectively; (2) a bottom portion of the stop-and-guide grooves in the mounting socket having a bias flange; and (3) a taper-shaped spring supported on the bias flange which is mounted between the stem and the mounting socket so as to retain the key unit in the stop-and-guide grooves.

4 Claims, 6 Drawing Sheets

KEY UNIT OF A KEYBOARD

BACKGROUND OF THE INVENTION

Generally, there are many kinds of key units for the keyboard; such conventional key units either cause inaccurate touch and conduction, or cause no sound indication upon hitting the key top. All such drawbacks of a key unit can more or less cause inconveniences to a user. Currently, there is an improved key unit (a mechanical type), but it includes many complicated parts aside from the high cost thereof. The drawbacks of the aforesaid key units are described further as follows:

(1). Resilient rubber type: this is a push button made of a resilient rubber similar to that of a telephone set; when it is used to key in a letter or the like, it makes no sound to indicate the conduction condition and also has no affirmative hit feeling. Further, after this type of key unit is used for a given period of time, the unit becomes unserviceable as a result of the rubber being hardened or damaged, i.e., the key unit is unable to revert to its normal position and resilient condition. Usually, when one key unit is out of order, it can not be replaced by a new one and the whole keyboard has to be replaced. It is deemed an inconvenient drawback for such equipment.

(2). Spring type: It is a key unit, in which a small spring is installed between the key top and the keyboard plate for providing a resilient force, but it is not a good design because the key top can start swinging. Since the distance from the key top to the conductive points is slightly long, more hitting force from a finger has to be applied before a letter or the like is keyed in. Moreover, the hit feeling is not certain because it makes no sound. In the event of keying in given information, some information might be missed because of there is no hit feeling and the keying speed might be slowed.

(3). Mechanical type: This is shown in FIG. 1, which is a reverse disassembled view of a mechanical keyboard, including a key top 7, a spring 6, a keyboard plate 9, and a key-supporting assembly 1 with a top cap 1A. The key-supporting assembly 1 includes a bottom cap 1B, a base plate 9'; the spring 6 is used for providing the key top with a given resilient force. The key-supporting assembly 1 includes a top cap 1A, a bottom cap 1B, a pushing unit 2, a small spring 3, two metal pieces 8, and a leaf spring 5. After the aforesaid parts are assembled together, the pushing unit 2 will protrude out of the top cap 1A and out of the keyboard plate 9 so as to be mounted under the key top 7; the spring 6 is mounted between the pushing unit 2 and the key top 7 so as to provide a resilient force and a "hit" feeling with a sound. However, it does like the aforesaid two types of key units to be turned on immediately upon being hit. Furthermore the conduction and buffer structure are complicated and expensive. It can provide the aforesaid function, but it would waste considerable time and man-power being assembled, i.e., its manufacturing cost is high, and the maintenance thereof is rather difficult because of the complicated structure. Another drawback of that mechanical type of key unit is that it is too sensitive, and is subject to causing error upon being hit incorrectly. When the spring type of key unit is used for keying in documents or data the user can feel nervous trying to avoid mis-hitting the key. After a long time using that type of keyboard, the user can suffer from occupational maladies such as numb fingers, tendinitis and sore shoulders etc.

SUMMARY OF THE INVENTION

This invention relates to an improved key unit of a keyboard which comprises a key top, a taper-shaped spring, a keyboard plate and a conductive film. The conductive film is mounted beneath the keyboard plate. The key top and a stem are cast together into one piece as a key unit. The stem has a blind hole therein and two salient blocks symmetrically arranged. Both sides of each salient block have two slits, which are higher than the salient blocks. A mounting base of the keyboard plate has a mounting socket with two guide grooves. Beneath the guide grooves, there are two stop-and-guide grooves respectively, being slightly deeper than the guide grooves. At the lower end of the mounting socket beneath the stop-and-guide grooves, there is a bias flange with a taper-shaped bias hole, in other words, the mounting socket and the center of the bias flange are not rested on concentric circles, the bias flange has a wider portion and a narrower portion. The taper-shaped spring is mounted on the bias flange, while the top of the taper-shaped spring in the mounting socket is mounted in the stem of the key top which is then retained in the stop-and-guide grooves. The prime object of the present invention is to provide an improved key unit of a keyboard which has a simple structure to facilitate assembly with the advantages of the mechanical type of key unit but without the drawbacks thereof. Its manufacturing cost is low. Another object of the present invention is to provide an improved key unit of a keyboard with less pats, a simple structure and easy maintenance.

DETAILED DESCRIPTION

Figure 1:
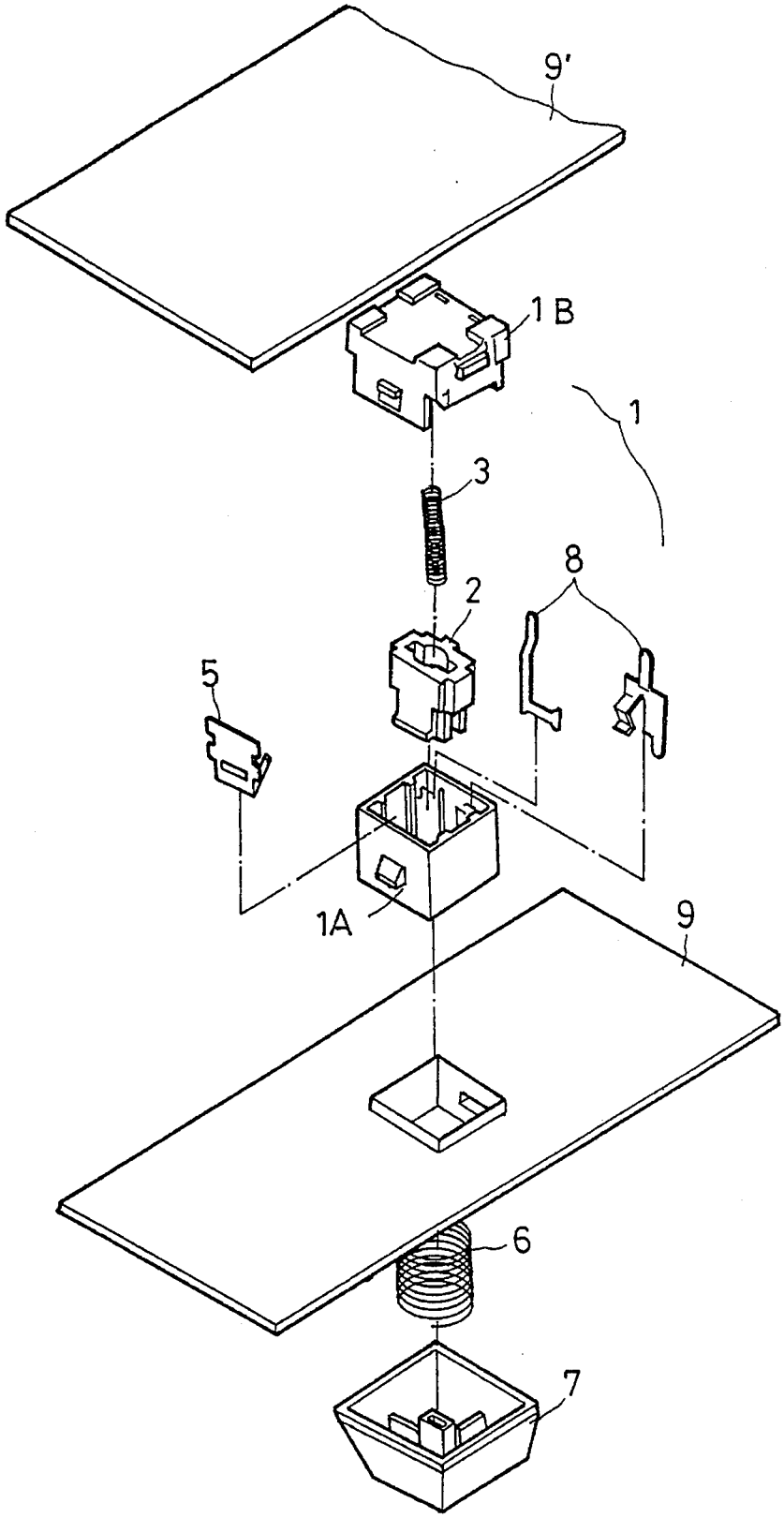
F I G. 1 (PRIOR ART)
FIG. 1 is a disassembled view of a conventional keyboard structure.
Figure 2:
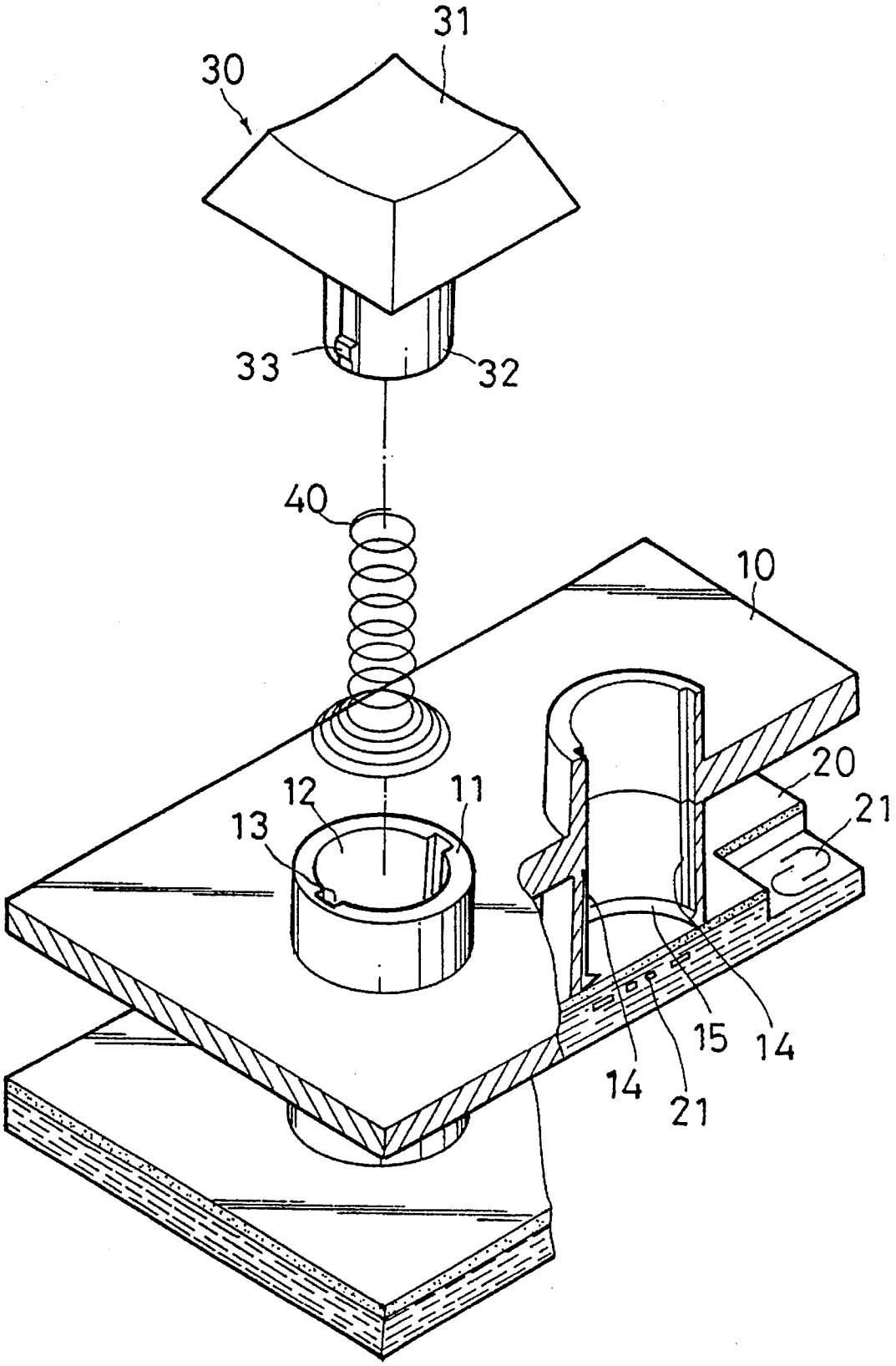
FIG. 2 is a disassembled view of an embodiment according to the present invention.
Figure 3:
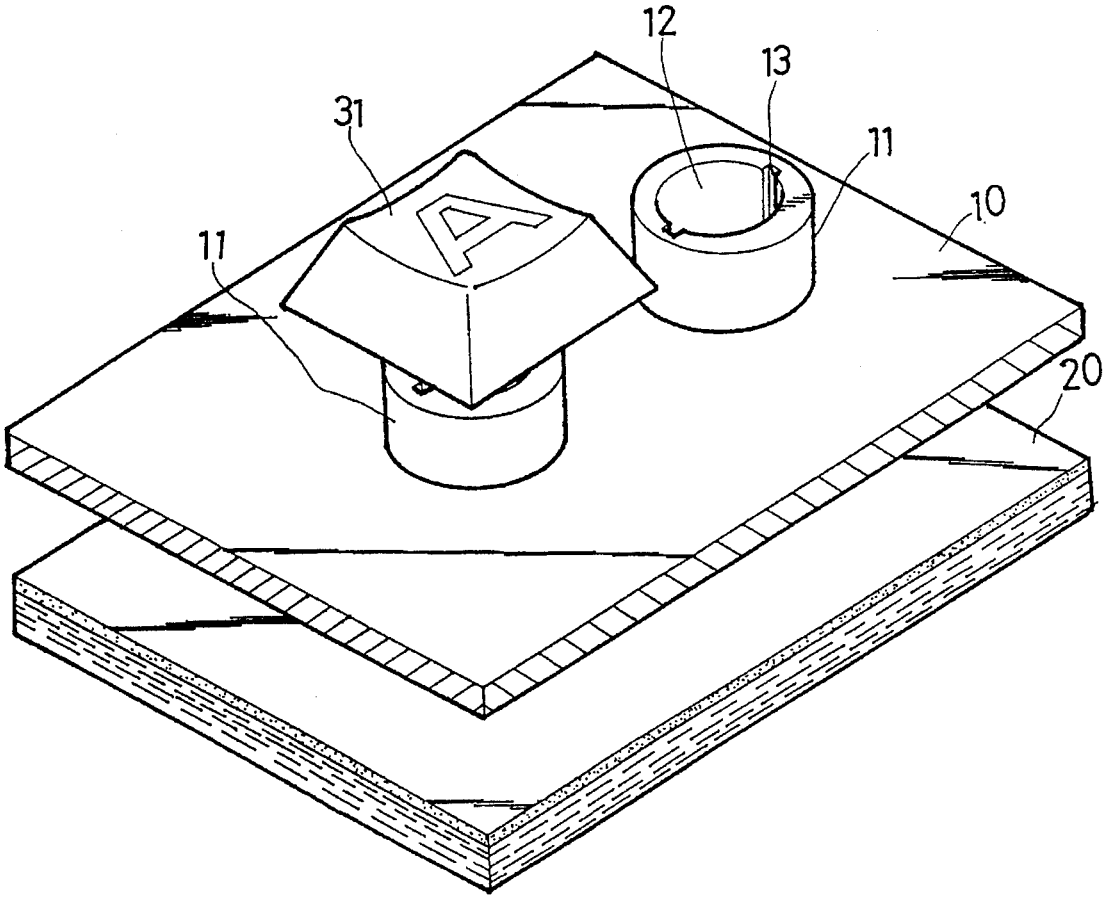
FIG. 3 is a perspective view of the present invention.
Figure 5:
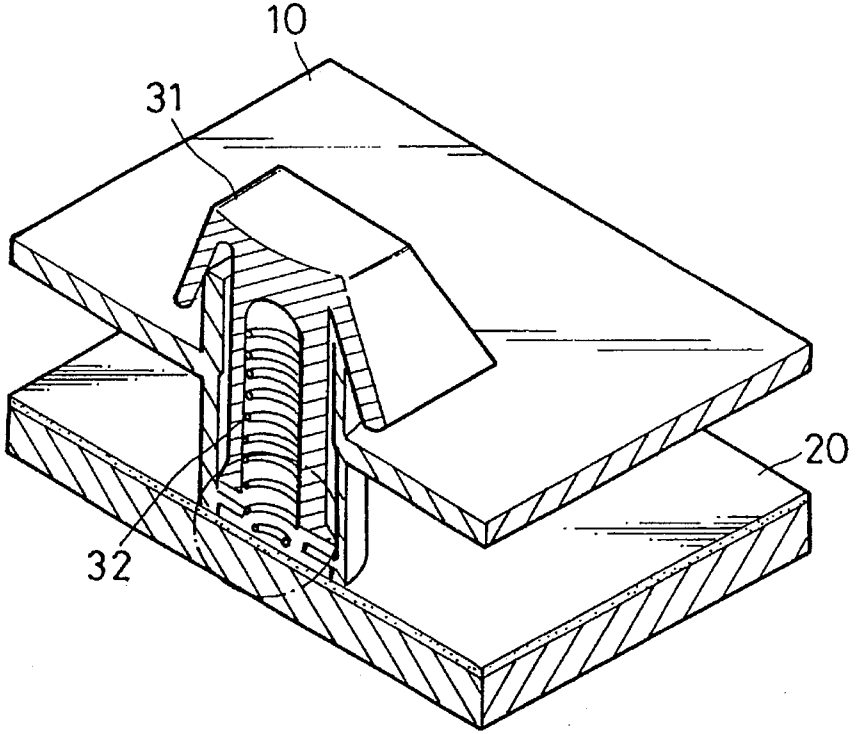
FIG. 5 is a sectional view of the key unit according to the present invention in conductive condition.
Figure 4:
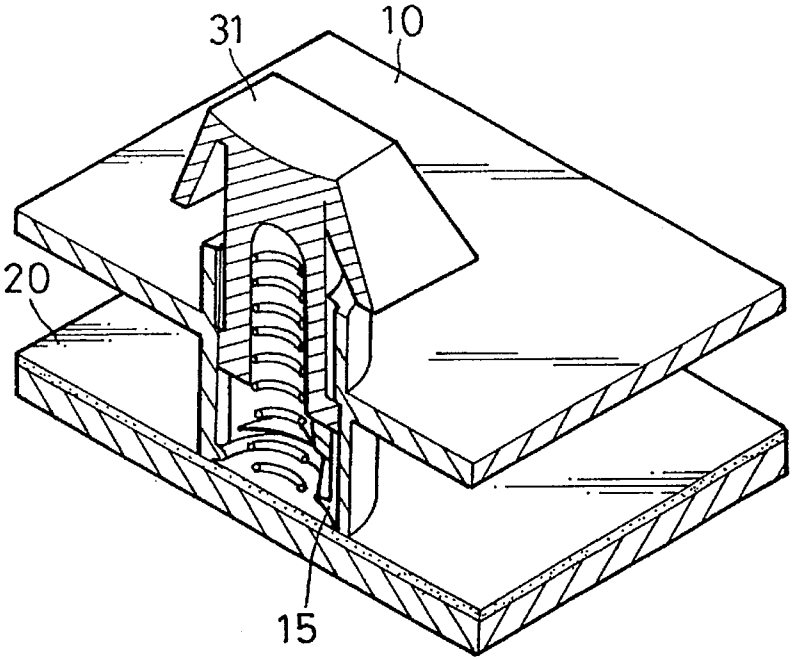
FIG. 4 is a sectional view of the key unit according to the present invention in non-conductive condition.

Referring to FIGS. 2 and 3, the present invention provides an improved structure in a key unit, and particularly relates to an improvement for the mounting socket 12 of the keyboard plate 10 and the key unit 30.

Figure 7:
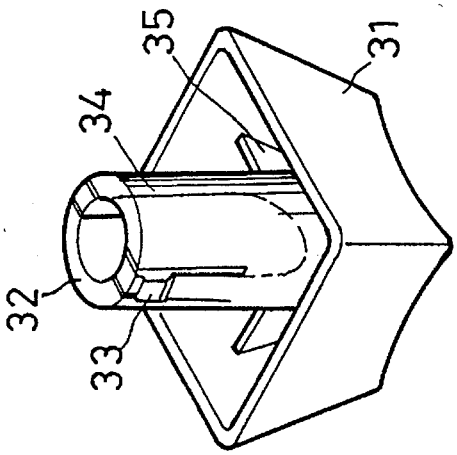
FIG. 7 is a perspective view of the key unit according to the present invention turned up-side-down.

The key unit 30 has a key top 31 with a stem 32, which are cast into one piece; the stem 32 has an opening with a blind hole 34 (as shown in FIG. 7), which is used for holding the top portion of a taper-shaped spring 40 mounted in a mounting base 11 of the keyboard plate 10. Two symmetrical sides of the lower end of the stem 32 are provided with two salient blocks 33 respectively. Both sides of the salient blocks 33 are furnished with two slits so as to provide the blocks 33 with a flexibility when pushed inwards.

The keyboard plate 10 is provided with a plurality of mounting bases 11 for a corresponding number of key units 30 (for example, if there are 101 key units, there will be 101 mounting bases 11). Each mounting base 11 includes a mounting socket 12, of which the inner surface has two symmetrical guide grooves 13. The space between the two guide grooves 13 is smaller than that between the two salient blocks 33 on two sides of the stem 32 in the lower part of the key unit 30 so as to enable the salient blocks 33 to be retained inside the mounting socket 12. Under the two guide grooves 13, there are two stop-and-guide grooves 14 respectively to retain the two salient blocks 33 in place without being pulled out unintentionally.

Figure 8:
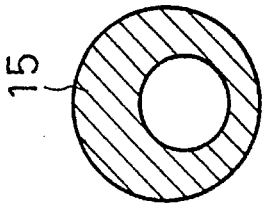
FIG. 8 is a top view of the flange of the present invention.

The stem 32 and the key top 31 are formed into one piece; when the stem 32 is mounted in the mounting socket 12, the key unit 30 will not swing back and forth because of the salient blocks 33 being mounted in the stop-and-guide grooves 14 respectively after the stem 32 being mounted in the mounting socket 12. In the bottom of the stop-and-guide grooves 14, there is a bias flange 15 (as shown in FIG. 8) with a taper-shaped bias hole. Since the bias flange 15 has a taper-shaped bias hole, the bottom of the taper-shaped spring 40 can sit thereon upon the spring 40 being mounted in the mounting socket 12. When the taper-shaped spring 40 is pressed with the key unit 30, the taper-shaped spring 40 will go downwards to touch the bottom of the bias flange 15 to generate a sound as a result of the small diameter portion of the spring 40. The lower end of the mounting socket 12 has a through hole, under which a conductive film 20 is mounted, and at least two conductive points 21 are provided under the conductive film 20.

Since the film circuit board 20 is mounted under the keyboard plate 10, and the taper-shaped spring 40 is mounted in the mounting socket 12, the bottom of the taper-shaped spring 40 can be set against the bias flange 15. After the salient blocks 33 on the stem 32 are inserted into the mounting socket 12 of the mounting base 11, the blind hole 34 of the stem 32 will hold the top of the taper-shaped spring 40. At the same time the key unit 30 will be retained in the mounting socket 12 upon the salient blocks 33 being pressed to slide into the stop-and-guide grooves 14 to retain the spring 40 in place so as to maintain the key unit 30 in place without jumping out unintentionally.

Figure 11:
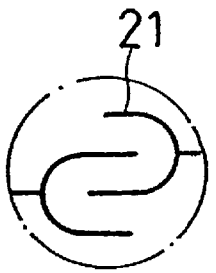
FIG. 11 is a top view of the conductive point according to the present invention.
Figure 10:
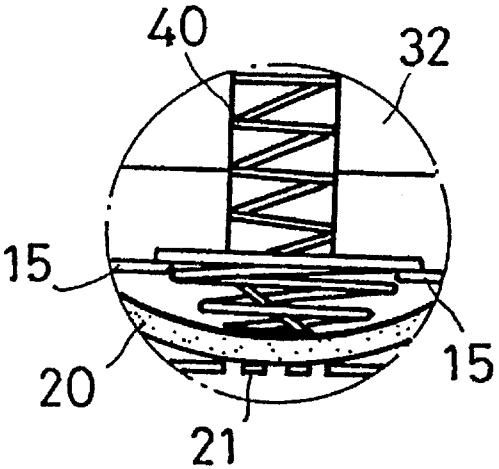
FIG. 10 is a sectional view of the present invention in conductive condition.
Figure 9:
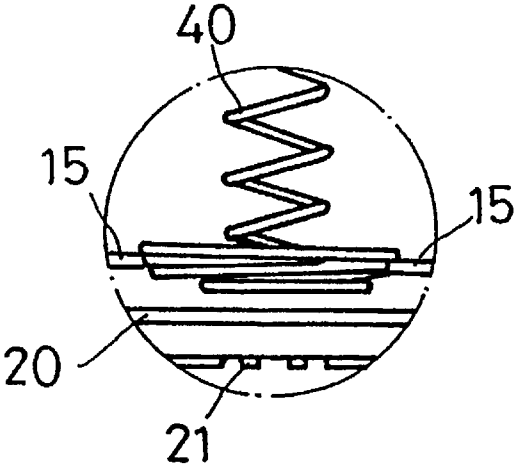
FIG. 9 is a sectional view of the present invention in non-conductive condition.

Referring to FIGS. 4, 5, 9 and 10, after the key unit 30 is assembled together, the taper-shaped spring 40 is under a pressed condition. The tapered portion, in other words, becomes a flat shape instead of a triangular shape with loaded energy to let the key top 31 maintain a jumping-up force. In that case, the taper-shaped spring 40 does not touch the conductive film 20 because of being supported by the bias flange 15. Therefore the conductive film 20 is not pressed down as shown in FIG. 9 to cause the conductive points 21 being connected to each other as shown in FIG. 10. As shown in FIG. 11, the two conductive points 21 will be connected electrically as soon as a conductor touches them simultaneously.

As soon as the key unit 30 is pushed downwards, the salient blocks 33 will slide down along the stop-and-guide grooves 14 respectively to cause the blind hole 34 of the stem 32 to press the top portion of the taper-shaped spring 40 downwards until the spring 40 becoming a reverse taper-shaped spring. When the key unit 30 is pushed to the bottom, the four connecting braces 35 in the key top 31 will sit on the opening of the mounting socket 12. At the same time the top portion of the taper-shaped spring 40 will be pushed down to press the conductive film 20 downwards to cause the two conductive points to be connected electrically. Now, the reverse taper-shaped spring 40 will touch and rub the edge of the bias flange 15 to generate a sound, which will indicate that the conductive points are connected electrically. Such sound will be generated between the tapered portion of the spring 40 and the edge of the bias flange 15 only when the taper-shaped spring 40 becomes a reverse taper-shaped spring to rub the edge of the bias flange 15 by the large diameter portion of the spring 40. Since the bias flange 15 is substantially a bias circle, the pressing force will be applied at a bias position, and therefore the sound generated will be a loud signal of an affirmative hit. In other words, the bias flange 15 is so designed that the reverse taper-shaped spring can touch the wide portion of the bias flange 15 in order to generate a loud sound and a better touch feeling for a user.

As soon as the pushing pressure applied to the key unit 30 is removed, the key unit 30 will revert up to its normal position with the taper-shaped spring 40 restored to its normal shape, i.e., the normal taper shape. Simultaneously a less loud sound will also be generated as a result of the spring 40 rubbing the wide portion of the bias flange 15. Then the conductive film 20 will also be raised because of the top portion of the spring 40 being lifted up. Then the two conductive points 21 are turned off.

Figure 6:
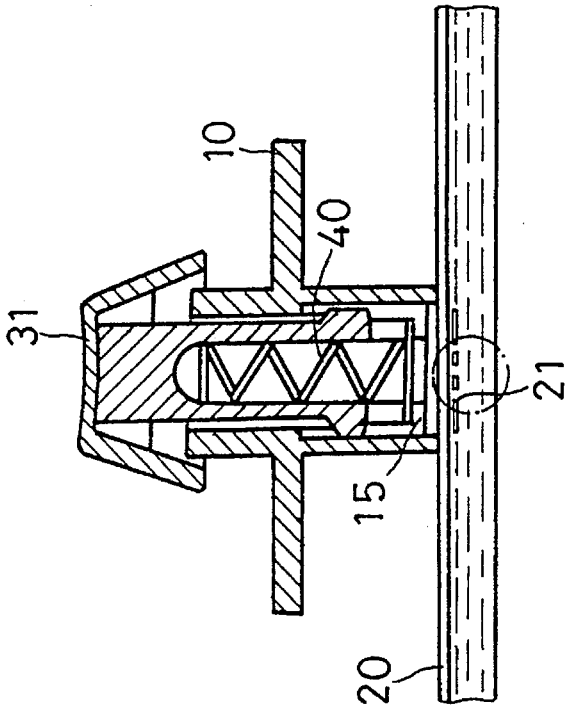
FIG. 6 is a sectional view of another embodiment according to the present invention showing the bottom portion thereof.

As shown in FIG. 6, the bias opening of the bias flange 15 in the mounting socket 12 can also be designed into a square opening.

I claim:

1. An improved key unit of a keyboard comprising a key top, a keyboard plate and a conductive film; said conductive film being mounted beneath said keyboard plate; said keyboard plate having a mounting base comprising a hollow cylinder mounted thereon; said key top being mounted on said mounting base through said hollow cylinder; said key unit further comprising:

a lower portion of said key top having a stem extending therefrom; said stem having a blind hole therein and two symmetrical sides, said stem also having two salient blocks mounted on said two symmetrical sides; said mounting base having a mounting socket comprising two symmetrical guide grooves therein; beneath said two guide grooves, said mounting socket further comprising two stop-and-guide grooves being furnished and aligned to said guide grooves, but being slightly deeper than said two guide grooves respectively;

a bottom portion of said stop-and-guide grooves in said mounting socket having a bias flange; and a taper-shaped spring supported on said bias flange which is mounted between said stem and said mounting socket so as to retain said key unit in said stop-and-guide grooves.

2. An improved key unit as claimed in claim 1, wherein said bias flange has a taper-shaped bias hole to facilitate said taper-shaped spring, said taper-shaped bias hole having an inner surface against which said taper-shaped spring rubs when a load is applied thereto, said rubbing of said taper-shaped spring against said taper-shaped bias hole generates a sound.

3. An improved key unit of a keyboard as claimed in claim 2, wherein said taper-shaped bias hole in said bias is a round hole.

4. An improved key unit of a keyboard as claimed in claim 1, wherein both sides of said salient blocks mounted on said two symmetrical sides of said stem have two slits, respectively.

* * * * *